US012274332B2

(12) United States Patent
Schwager

(10) Patent No.: US 12,274,332 B2
(45) Date of Patent: Apr. 15, 2025

(54) BUCKLE

(71) Applicant: Lindnerhof-Taktik GmbH, Lenggries (DE)

(72) Inventor: Martin Schwager, Penzberg (DE)

(73) Assignee: LINDNERHOF-TAKTIK GMBH, Lenggries (DE)

( * ) Notice: Subject to any disclaimer, the term of this patent is extended or adjusted under 35 U.S.C. 154(b) by 0 days.

(21) Appl. No.: 18/165,261

(22) Filed: Feb. 6, 2023

(65) Prior Publication Data

US 2023/0263272 A1 Aug. 24, 2023

(30) Foreign Application Priority Data

Feb. 22, 2022 (DE) ..... 10 2022 104 175.1

(51) Int. Cl.
*A44B 11/00* (2006.01)
*A44B 11/25* (2006.01)

(52) U.S. Cl.
CPC ..... *A44B 11/258* (2013.01); *A44B 11/006* (2013.01); *A44B 11/2596* (2013.01)

(58) Field of Classification Search
CPC . A44B 11/258; A44B 11/2596; A44B 11/006; Y10T 24/40
See application file for complete search history.

(56) References Cited

U.S. PATENT DOCUMENTS

| | | | | |
|---|---|---|---|---|
| 9,125,458 | B2 * | 9/2015 | Grimm | A44B 11/2596 |
| 10,918,169 | B2 * | 2/2021 | Kolasa | A44B 99/00 |
| 11,044,970 | B1 * | 6/2021 | Chan | A44B 11/2592 |
| 2007/0256282 | A1 * | 11/2007 | Sim | A44B 11/006 24/163 R |
| 2008/0061098 | A1 | 3/2008 | Hoffner | |
| 2011/0061211 | A1 | 3/2011 | Anscher | |
| 2012/0175391 | A1 | 7/2012 | Rogers et al. | |
| 2013/0181083 | A1 | 7/2013 | Salentine et al. | |
| 2014/0075722 | A1 * | 3/2014 | Zutis | A01K 27/002 24/1 |
| 2014/0196203 | A1 * | 7/2014 | Cole | F41H 1/02 24/305 |
| 2014/0325803 | A1 | 11/2014 | Iannello et al. | |
| 2015/0135483 | A1 * | 5/2015 | Grimm | A44B 11/2596 24/700 |
| 2022/0312903 | A1 * | 10/2022 | Thompson | A44B 11/006 |

FOREIGN PATENT DOCUMENTS

| | | | |
|---|---|---|---|
| CA | 2953176 | A1 | 6/2018 |
| DE | 69906020 | T2 | 2/2004 |
| WO | 2009048584 | A1 | 4/2009 |

OTHER PUBLICATIONS

Canadian Intellectual Property Office, Office Action Issued in Application No. 3,190,133, Jun. 4, 2024, 3 pages.

* cited by examiner

*Primary Examiner* — Jason W San
*Assistant Examiner* — Michael S Lee
(74) *Attorney, Agent, or Firm* — McCoy Russell LLP

(57) ABSTRACT

The present disclosure comprises a buckle for connecting a functional element to a webbing loop, having a base element which comprises a bottom region and two web elements and can be inserted under the webbing loop in such a way that the bottom region is arranged below the webbing loop and the web elements engage around the webbing loop on both sides, and having a connecting element which can be latched to the web elements of the base element arranged on the webbing loop.

20 Claims, 9 Drawing Sheets

BUCKLE

CROSS REFERENCE TO RELATED APPLICATION

The present application claims priority to German Patent Application No. 10 2022 104 175.1 filed on Feb. 22, 2022. The entire contents of the above-listed application are hereby incorporated by reference for all purposes.

TECHNICAL FIELD

The present disclosure relates to a buckle for connecting a functional element to a webbing loop. In particular, the buckle may serve to connect a functional element such as a modular protective element to a webbing loop of a plate carrier, in particular a protective vest.

The webbing loop can be, for example, a PALS loop of a MOLLE system. The webbing loop can also be formed by a textile material layer in which slots are made.

BACKGROUND

Until now, modular protective elements of plate carriers have often not been quick and easy to detach. The fastening straps of the shoulder plates are usually velcroed into the shoulder strap of the plate carrier. However, the connection via a Velcro fastener gets dirty easily. In addition, Velcro connections cause annoying noises.

SUMMARY

Buckles are already known for connecting functional elements to webbing loops, the base element of which comprises webbing receptacles slotted on both sides into which the webbing loop is threaded. The webbing loop is thus connected to the webbing receptacles at the two edge regions of the base element and runs in the central part of the base element on its rear side. Various attachments can be fitted to the free central part of the base element.

For example, DE 69906020 T2 shows a base element that can be mounted horizontally and vertically on PALS webbing by means of slotted webbing receptacles. Various attachments can be slid into a central receptacle of the base element and locked in place with a snap connection.

Further buckles are known from US2012175391A1, WO2009048584A1, US2014325803A1, US2013181083A1 and CA2953176A1.

It is an object of the present disclosure to provide an improved buckle for connecting a functional element to a webbing loop.

This object is achieved by a buckle according to claim 1. Embodiments of the present disclosure are the subject-matter of the subclaims.

The present disclosure comprises a buckle for connecting a functional element to a webbing loop, having a base element which comprises a bottom region and two web elements and can be inserted under the webbing loop in such a way that the bottom region is arranged below the webbing loop and the web elements engage around the webbing loop on both sides, and having a connecting element which can be latched to the web elements of the base element arranged on the webbing loop.

Unlike the prior art, the base element is therefore no longer connected by means of slotted webbing receptacles, but by the base element being inserted under the webbing loop. The connection of the connecting element to the base element is made via the web elements, which engage around the webbing loop on both sides. This provides a stable and easy-to-use connection to a webbing loop.

According to a possible embodiment of the present disclosure, the bottom region of the base element comprises at least one recess. This can save weight and material. In particular, the bottom region can be formed by two webs which, in the connected state, extend under the webbing loop and connect the two web elements to one another, wherein a recess is provided between the webs.

According to a possible embodiment of the present disclosure, the connecting element comprises at least one spring arm, at the free end of which a latch element is provided. Optionally, the latch element can be latched to at least one counter element arranged on a web element of the base element.

This allows easy latching of the connecting element to the base element.

According to a possible embodiment of the present disclosure, the spring arm comprises a chamfer at the end of which the latch element is arranged.

According to a possible embodiment of the present disclosure, the at least one spring arm can be inserted or is insertable under at least one retaining region of the web elements for connection to the base element.

According to a possible embodiment of the present disclosure, the spring arm rests on the webbing loop in the connected state. The webbing loop thereby optionally pushes the latch element into the latched position. The latch element is optionally released by pushing the spring arm against the webbing loop, the elasticity of which allows a certain amount of yielding.

Optionally, the webbing loop lies at least partially on the bottom region of the base element in a region that is located between the latch element and the free end of the spring arm in the connected position. This prevents accidental release of the spring arm during operation.

According to a possible embodiment of the present disclosure, the counter element of the latch element is formed by an end portion of the retaining region of the web element.

According to a possible embodiment of the present disclosure, an engagement of the latch element with the base member is releasable by pushing the spring arm toward the bottom region.

According to a possible embodiment of the present disclosure, the spring arm comprises a recess and or one or more bead elements. This facilitates operation, in particular operation with gloves, since the point at which the spring arm must be pressed for release is haptically marked.

According to a possible embodiment of the present disclosure, the at least one spring arm extends between the web elements in the connected state. In this way, it is protected by the web elements against unintentional release.

According to a possible embodiment of the present disclosure, the retaining regions project inwardly from the web elements, respectively.

According to a possible embodiment of the present disclosure, the latch element engages around the counter element from below. In particular, it is provided that the latch element engages around a front edge of a retaining region, under which the spring arm extends in the latched state, from below.

According to a possible embodiment of the present disclosure, the connecting element comprises a support element that engages around the web elements of the base element in the connected state. In this way, the support element secures the connecting element against tensile loads on the base element. In particular, the support element engages around the web elements transversely to the longitudinal direction of the webbing loop and thus secures them in the longitudinal direction of the webbing loop. In particular, the support element engages around the end regions of the web elements.

According to a possible embodiment of the present disclosure, the end regions of the web elements engaged around by the support element are chamfered inwardly toward the bottom region. Optionally, this braces the support element, when it is pulled away from the base element, with the end regions.

According to a first possible embodiment of the present disclosure, the support element surrounds the web elements in the connected state in a frame-like manner on their outer sides. Optionally, however, the spring arm extends between the web elements.

According to a possible embodiment, the web elements pass through two recesses arranged between the spring arm and the frame-like support element. Optionally, the end regions of the recesses engage around the end regions of the web elements.

According to a second possible embodiment of the present disclosure, the support element extends between the web elements in the connected state. Optionally, two spring arms are provided which extend on both sides of the support element between the support element and the web elements.

According to a possible embodiment, the support element engages around the end regions of the web elements and has widened regions for this purpose, which engage around the end regions of the web elements with their inner edges.

According to a possible embodiment of the present disclosure, the support element and the at least one spring arm extend parallel to each other in a deformation region of the support element and are separated from each other by a optionally slot-shaped recess, so that the support element and the spring arm are deformable in opposite directions.

According to a possible embodiment of the present disclosure, the connecting element and/or the support element comprises at least one connecting region for connection to a webbing element.

In particular, the connecting region may comprise a recess through which the webbing element can be passed, especially in the form of an elongated hole.

According to a possible embodiment of the present disclosure, the at least one connecting region is provided in an edge region of the connecting element.

According to a possible embodiment of the present disclosure, the connecting region is arranged outside the base area of the base element in the connected state.

According to a possible embodiment of the present disclosure, the connecting element comprises a connecting region in at least two opposing edge regions.

According to a possible embodiment of the present disclosure, the connecting element and/or support element are plate-shaped.

According to a possible embodiment of the present disclosure, the connecting element and/or support element extends parallel to the bottom region of the base element in the connected state.

According to a possible embodiment of the present disclosure, the connecting element can also be directly connected to the webbing loop, in particular by sliding the spring arm under the webbing loop.

According to a possible embodiment of the present disclosure, the buckle comprises a reinforcement element which surrounds the webbing loop in a sleeve-like manner in the assembled state and stabilizes the webbing loop when the connecting element is directly connected.

According to a possible embodiment, the reinforcement element comprises a slot extending in the longitudinal direction. Optionally, this is arranged to lock with a latch element of the spring arm.

According to a possible embodiment of the present disclosure, the base element, the connecting element and/or the reinforcement element are produced from plastics. In particular, the elements are each manufactured in one piece and/or by injection molding.

The present disclosure further comprises a base member for a buckle as described above, wherein the base member comprises a bottom region and two web elements and can be inserted under the webbing loop such that the bottom region is arranged below the webbing loop and the web elements engage around the webbing loop on both sides.

According to a possible embodiment, the web elements comprise retaining regions that project inward.

According to a possible embodiment, the end regions of the web elements are chamfered inward toward the bottom region.

In particular, the base element can be configured as already described above.

The present disclosure further comprises a connecting element for a buckle as described above, wherein the connecting element comprises at least one spring arm and at least one support element, wherein the support element and the at least one spring arm extend parallel to each other in a deformation region of the support element and are separated from each other by an optionally slot-shaped recess.

In particular, the connecting element can be configured as already described above.

The present disclosure further comprises a set consisting of the connecting element and a reinforcement element as described above.

The present disclosure further comprises an article, in particular a ballistic protective vest, having a buckle as described above.

The article may comprise a loop on which the buckle is arranged. The loop can be a sewn-on webbing loop or a loop formed by a textile layer in which slots are made. In particular, it is a PALS loop, in particular of a MOLLE connection system.

According to a possible embodiment, the buckle is used to connect a ballistic element to the ballistic protective vest, in particular to connect a ballistic plate to a shoulder webbing loop of the ballistic protective vest.

The present disclosure will now be described in more detail with reference to exemplary embodiments and drawings.

DETAILED DESCRIPTION

A first exemplary embodiment of a buckle according to the disclosure will now be described with reference to FIGS. 1 to 7. FIGS. 1 to 4 show the function of the buckle, FIGS. 5 to 7 show details of the construction.

The buckle according to the disclosure is used to connect a functional element to a webbing loop 3 of an article 1 that can be worn on the body, for example a protective vest. In the exemplary embodiment, the functional element, which is not shown, is connected via a webbing element 5, which is fastened to the webbing loop 3 by means of the buckle.

Figure 2:
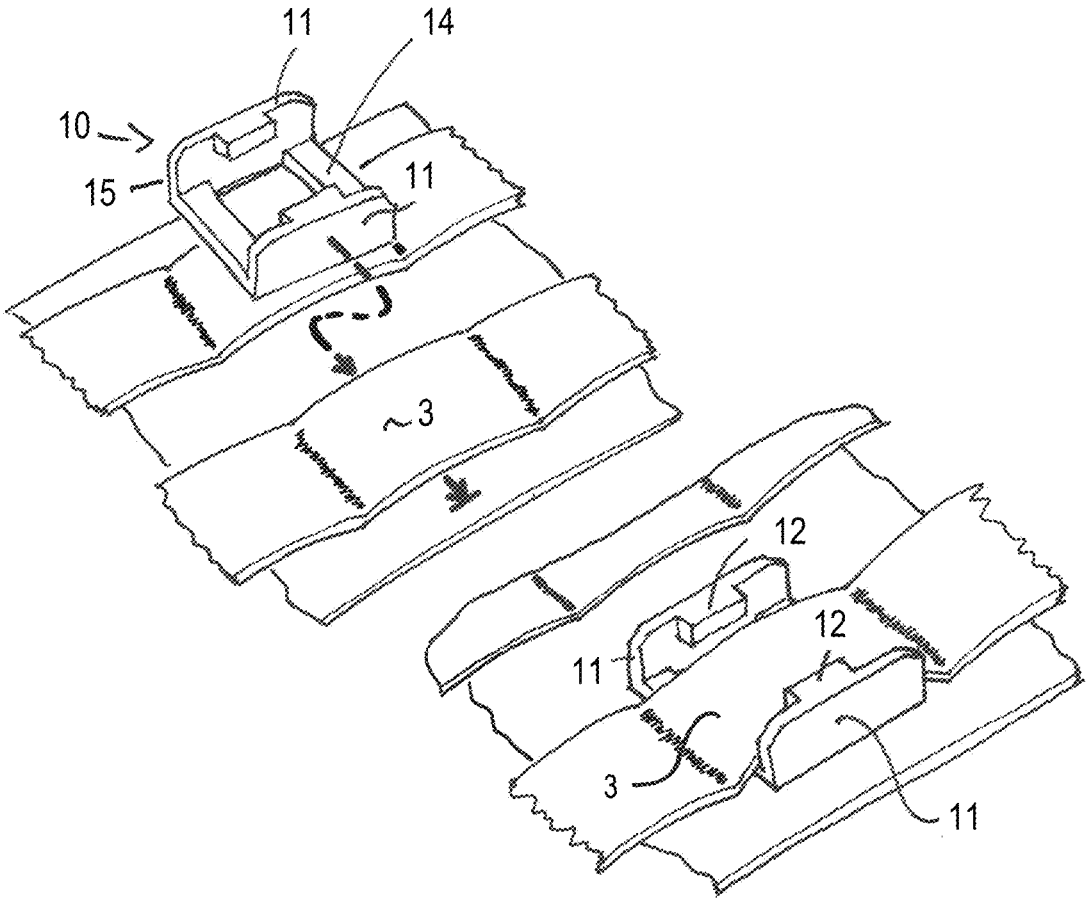

The buckle consists of a base element 10, which can be slid under the webbing loop 3 as shown in FIG. 2, and a connecting element 20, which can be connected to the base element 10.

Figure 6:
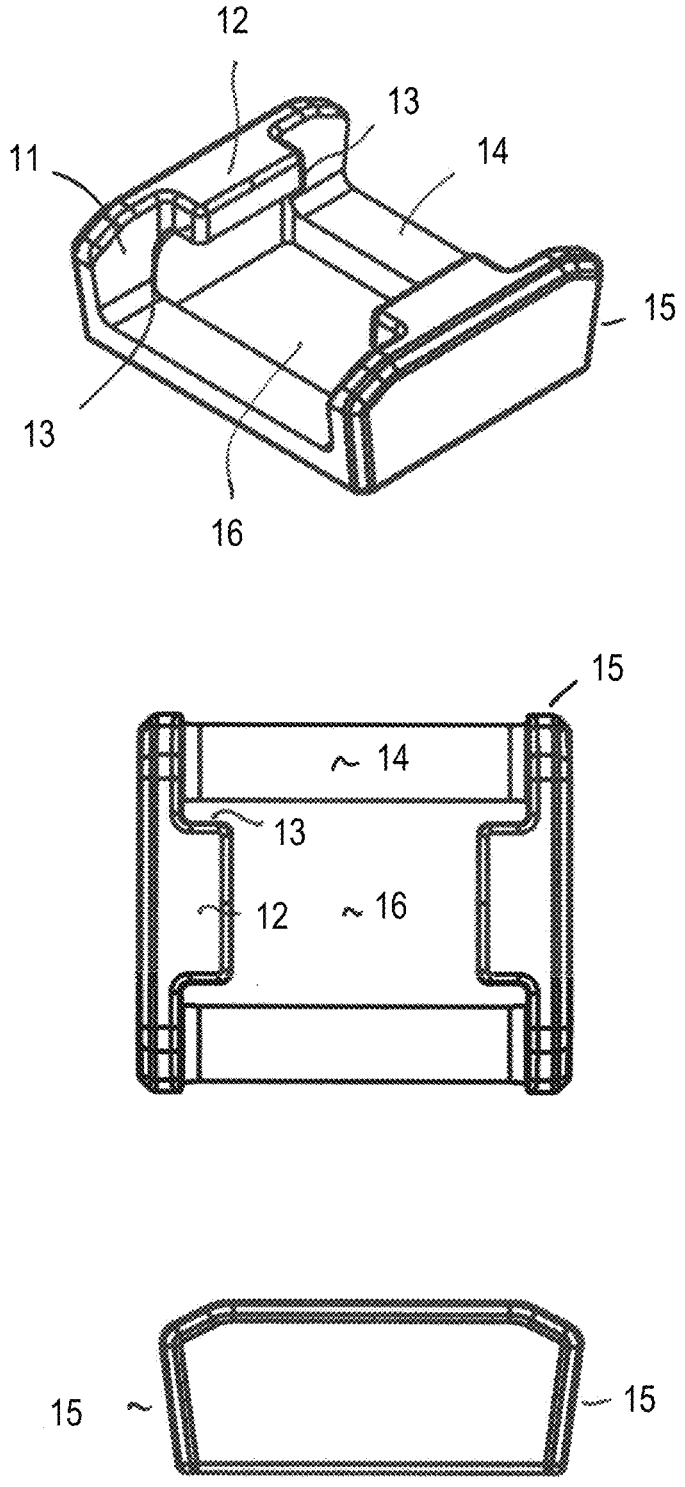
Figure 7:
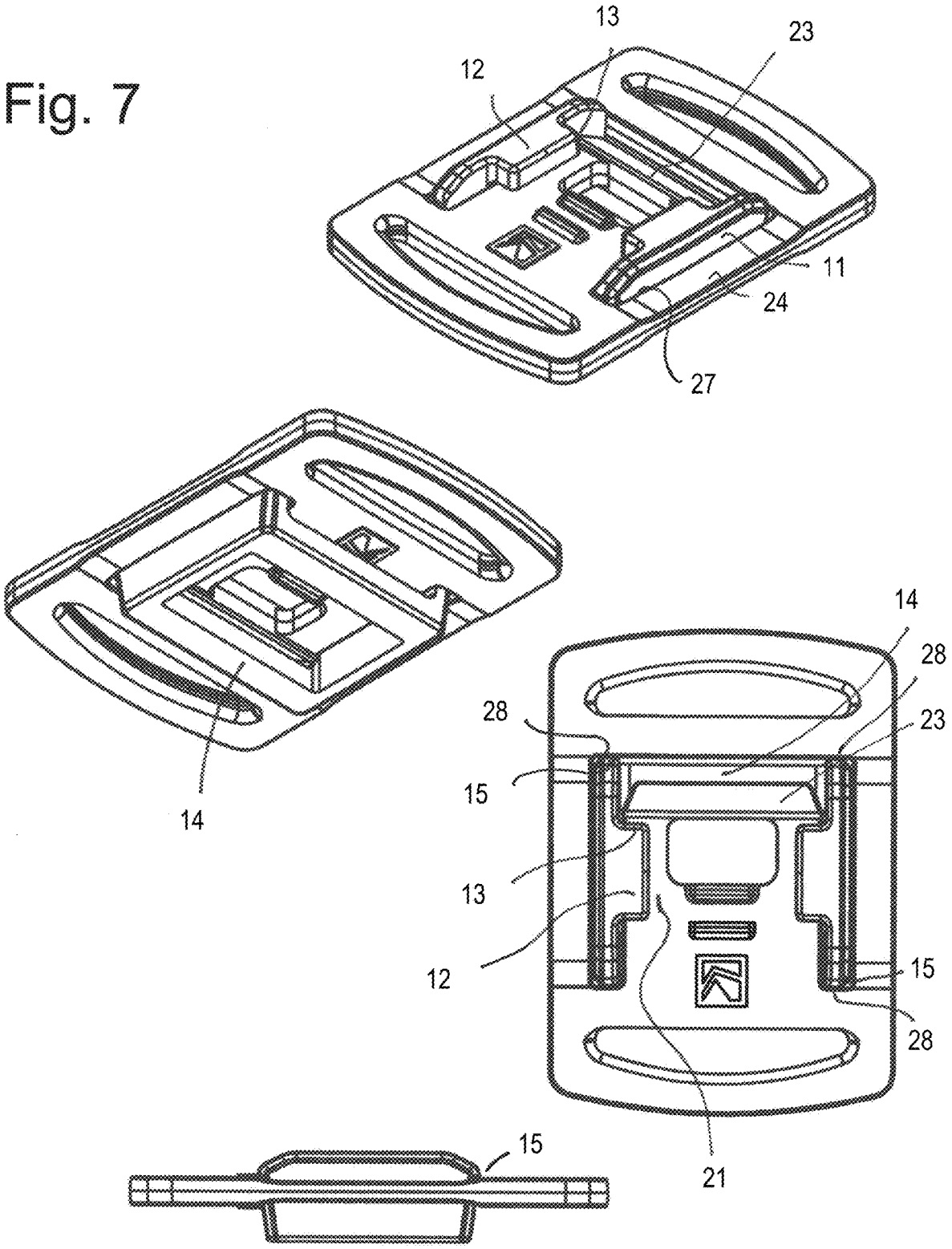

As can be seen in FIGS. 2 and 6, the base element comprises a bottom region 14 and two web elements 11 which, when connected to the webbing loop 3, extend on both sides of the webbing loop in the longitudinal direction of the webbing loop, so that the base element engages around the webbing loop on both sides, while the bottom region 14 passing under and through the webbing loop 3 connects the web elements 11 transversely to the extension direction of the webbing loop 3.

In the exemplary embodiment, the bottom region 14 of the base element is formed by two webs 14 running transversely to the extension direction of the webbing loop 3, between which a recess is provided. This saves material and weight and facilitates manufacture, since the injection mold does not have to be as complex.

The connecting element 20 is connected to the web elements 11 laterally engaging around the webbing loop 3 to close the buckle and secured thereto by a latch.

Figure 1:
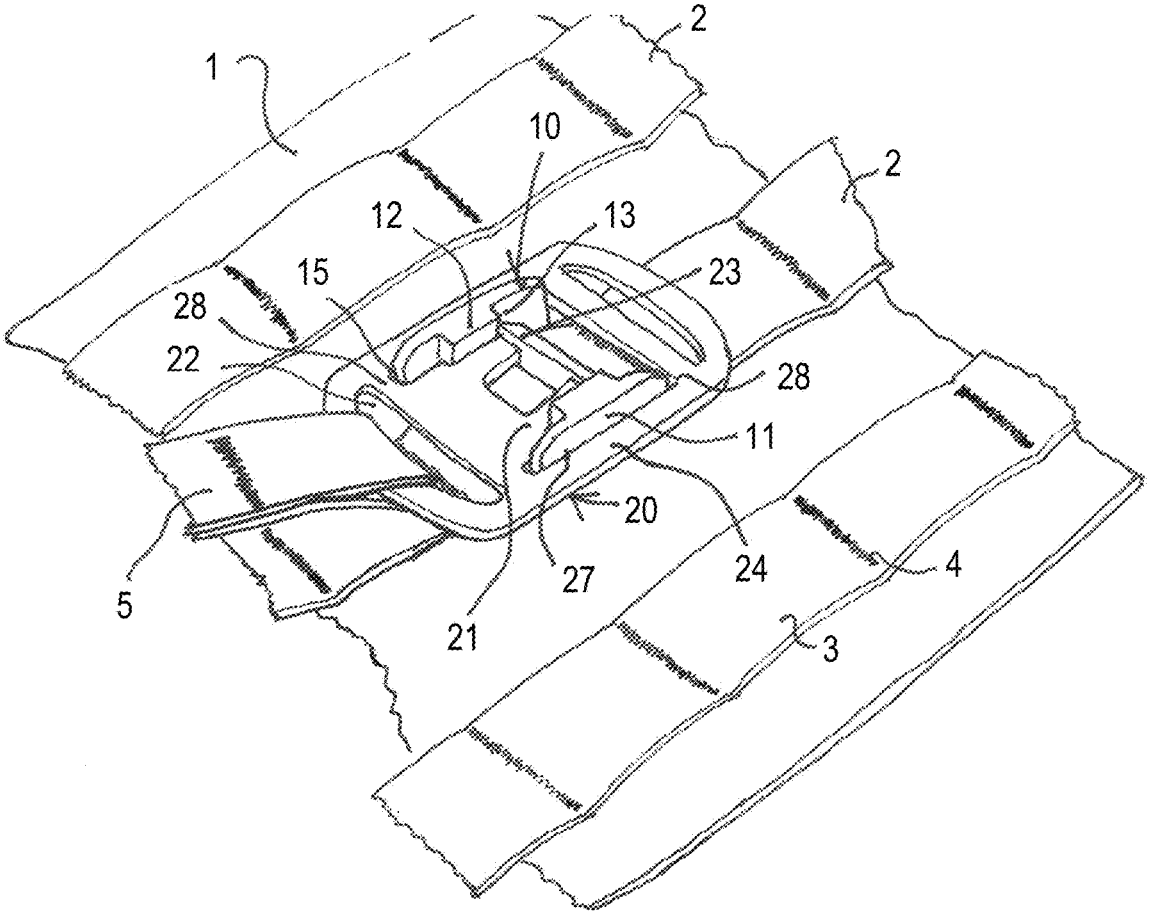
FIG. 1 an exemplary embodiment of an article wearable on the body with an exemplary embodiment of a buckle according to the disclosure in a perspective view, FIG. 2 attaching the base element to the webbing loop, FIG. 3 attaching the connecting element to the base element, FIG. 4*a* an alternative connection of the connecting element directly to a webbing loop, FIG. 4*b* the direct connection to a webbing loop shown in FIG. 4*a*, the webbing loop being reinforced by a reinforcement element, and the reinforcement element in a perspective view, FIG. 5 construction drawings of the connecting element showing a perspective view, a top view and a side view, FIG. 6 construction drawings of the base element showing a perspective view, a top view and a side view, FIG. 7 construction drawings of the connecting element and the base element in the connected position, each with a perspective view from above and from below, a top view and a side view, FIG. 8 a first alternative exemplary embodiment of a connecting element with only one connecting region, FIG. 9 a second alternative exemplary embodiment of a connecting element having four connecting regions, and FIG. 10 a third alternative exemplary embodiment of a connecting element with a support element extending between the web elements and two spring arms.
Figure 3:
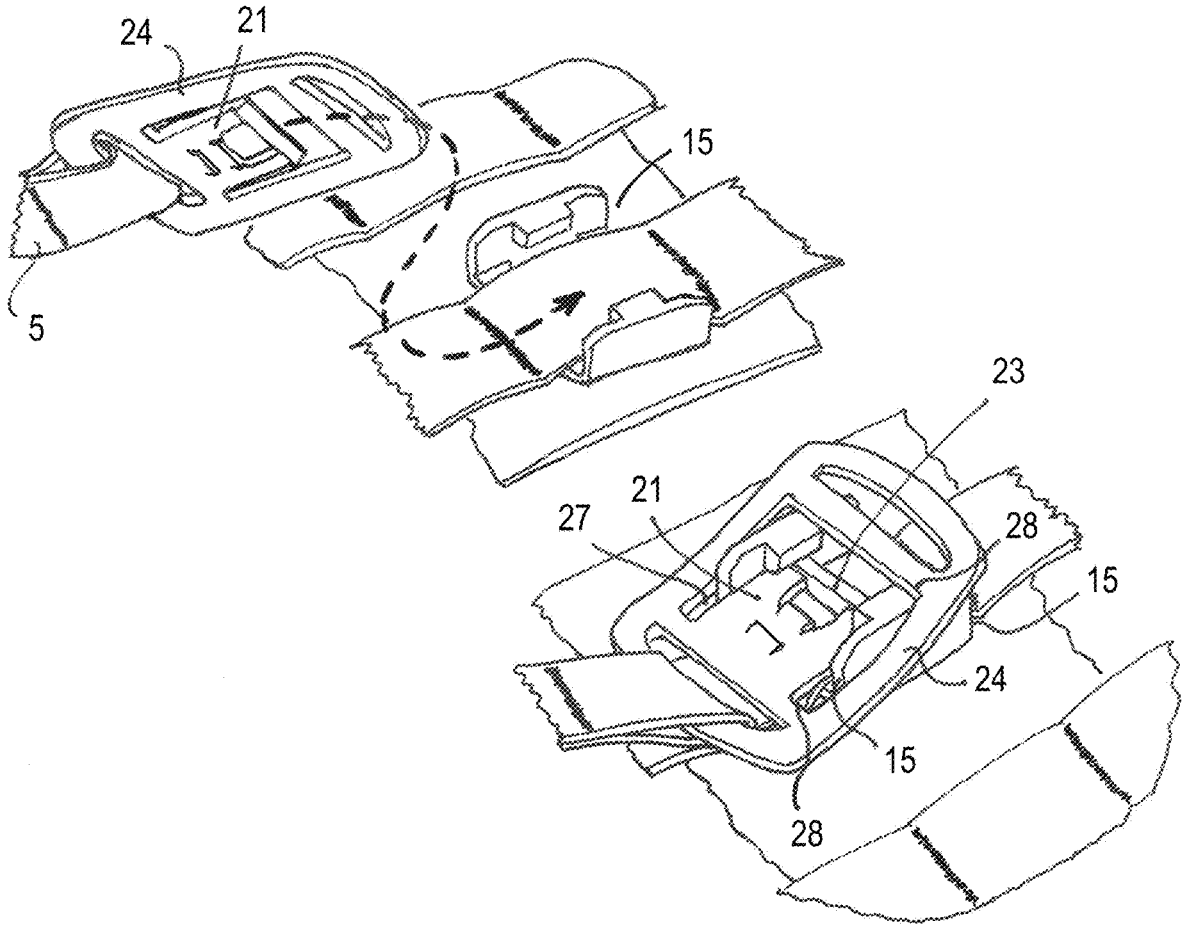

For this purpose, the connecting element 20 comprises a spring arm 21 which, as shown in FIG. 3, is pushed under retaining elements 12, which project laterally from the web elements 11, for fastening with the base element and latches in the inserted position shown in FIG. 1. A latch element 23 is provided on the spring arm for this purpose, which latches with counter elements 13 of the web elements 11.

In the exemplary embodiment, the counter elements 13 are formed by the end regions of the retaining elements 12, under which the spring arm is slid. The latch element locks from below with the lower front edge of the respective retaining element 12.

The free end of the spring arm 21 has a chamfer, the chamfered end of which forms the latch element 23. The spring arm 21 is therefore slid under the retaining elements 12 with the chamfer. Once the chamfer has completely passed the retaining elements 12, the connecting element 20 is in the locked position, in which the latch element locks with the ends of the retaining elements 12 acting as a counter element.

In the exemplary embodiment, the two retaining elements are each arranged on the inside of the respective web element 11, wherein the spring arm 21 is slid under the retaining elements 12 between the two web elements. In the inserted position, the spring arm 21 therefore rests on the webbing loop 3, which in turn rests on the bottom region 14.

As can be seen from the respective top view in FIGS. 6 and 7, a web of the bottom region is provided in the region of the free end of the spring arm 21. As a result, the free end of the spring arm 21 rests on the webbing loop in the latched position in a region in which it is supported by the web of the bottom region. In the region of the retaining elements 12, on the other hand, the bottom region 14 comprises a recess 16 which simplifies manufacture.

The latch is released by pressing the spring arm 21 into the buckle onto the webbing loop, which yields sufficiently due to its elasticity, to release the latch element.

In the exemplary embodiment, the spring arm 21 comprises a recess 25 as well as bead elements 26, which facilitate operation with gloves. The recess 25 is located in the region between the two retaining elements 12 in the closed state of the buckle.

The connecting element 20 comprises one or more connecting regions 22 for connection with a webbing element 5. In the exemplary embodiment, the connecting regions 22 are formed by recesses through which a webbing loop passes. The edges of the connecting element 20 therefore form webs 29 around which the webbing loop 5 is placed. The recesses 22 are closed.

In the exemplary embodiment shown in FIGS. 1 to 7, connecting regions 22 are provided in the longitudinal direction of the webbing loop 3 on opposite sides of the connecting element 20 in each case. The connection with the webbing element 5 is therefore made here in the longitudinal direction of the webbing loop 3.

Figure 8:
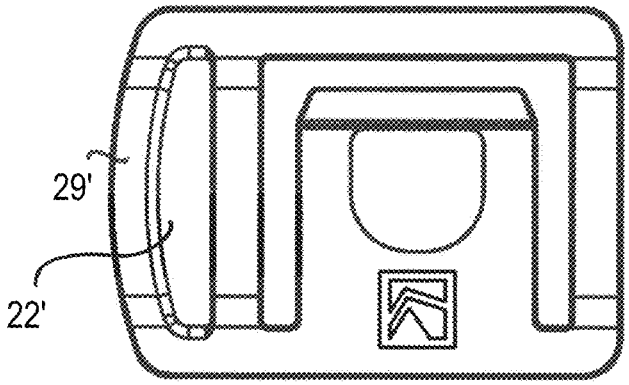
Figure 9:
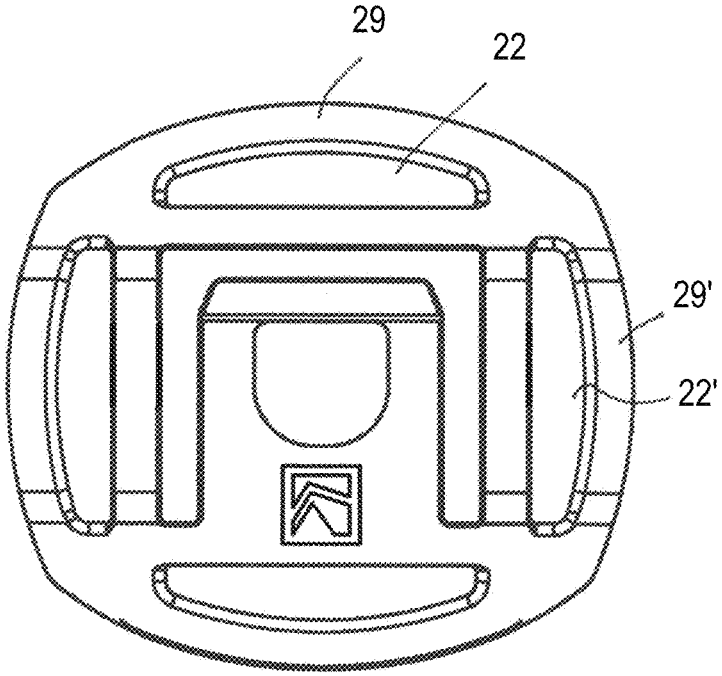

However, as can be seen from the alternative embodiments shown in FIGS. 8 and 9, the present disclosure is not limited to this arrangement of the connecting regions. Rather, connecting regions may be provided on any sides of the connecting element. Also, the number of connecting regions is arbitrary and only one connecting region may be provided.

In the exemplary embodiment in FIG. 8, only one connecting element 22' arranged transversely to the longitudinal direction of the webbing loop 3 is provided. The connection of the webbing element 5 is therefore made here transversely to the longitudinal direction of the webbing loop 3. Here, too, the connecting region is formed by a recess 22' and a web 29'.

In the exemplary embodiment in FIG. 9, connecting regions 22 are provided on all four sides of the connecting element 20, and the connection of the webbing element 5 can therefore be performed in the longitudinal direction and transversely to the longitudinal direction of the webbing loop 3.

As can be seen in particular from FIG. 5, the connecting element is plate-shaped. In the exemplary embodiment, the connecting element comprises a latch element on both main sides so that it can be connected to the base element regardless of its orientation. In particular, both main sides have an identical configuration and/or the connecting element has a symmetrical configuration with respect to its center plane.

To secure the connecting element 20 to the base element 10, the latter comprises a support element 24 which, in the connected state, engages around the web elements 11.

For this purpose, the support element 24 in the exemplary embodiment comprises edges 28 extending transversely to the extension of the web elements 11, which engage around the end regions 15 of the web elements 11. In the exemplary embodiment, the support element surrounds the web elements 11 on both longitudinal sides.

In the exemplary embodiment, the support element 24 extends parallel to the spring arm 21 in the longitudinal direction of the connecting element and longitudinally connects the edges 28 that engage around the two end portions 15 of the web elements 11.

In particular, the support element 24 connects at least one connecting region 22 to the longitudinally opposite edges 28, with which the connecting element is supported on the end regions 15 of the web elements 11 when subjected to a tensile load in the longitudinal direction, thereby securing the connecting element to the base element.

As can be seen in particular from the side view in FIG. 6, the end regions 15 of the web elements 11 extend obliquely inwards from their upper edge towards the bottom region 14. As a result, the edges 28 of the support element, as can be seen from the corresponding side view in FIG. 7, brace with the end regions 15 in the event of a tensile load and cannot slip off these, since in the event of a tensile load the connecting element is pressed by the slopes 15 in the direction of the bottom region 14 onto the webbing loop located between the bottom region 14 and the connecting element 20.

The longitudinally extending portions of the support element 24 and the spring arm 21, which extend parallel to each other, are separated from each other by a recess 27 so that the two portions can be deformed independently of each other. In particular, this allows the spring arm 21 to be bent downward out of the plane of the connecting element as shown in FIG. 3 to be slid under the retaining elements 12, while the support element is bent upward to slide the edges 28 over the web elements 11. Here, the edges 28 slide along the upper edges of the web elements 11 until they engage around the web elements in their end regions 15.

In the connected state, as shown in FIGS. 1 and 7, spring arm 21 and support element 24 again extend in one plane.

In the exemplary embodiment, the support element 24 is made thinner in the region in which it extends parallel to the spring arm 21 than in its end regions in which the connecting elements 22 are provided. This increases the flexibility in this area.

In the exemplary embodiments shown in FIGS. 1 to 9, the support element 24 comprises two arms in the region in which it extends parallel to the spring arm, each of which extends on the outer side of the web elements 11. The support element therefore surrounds the web elements in a frame-like manner in the connected state. The spring arm, on the other hand, extends between the two web elements 11. The web elements 11 therefore pass through the recess 27 between the spring arm 21 and the arms of the support element 24 in the connected state. The edges 28 are formed by the longitudinal ends of this recess 27.

When a tensile load is applied transversely to the longitudinal direction of the webbing and thus transversely to the longitudinal direction of the web elements 11, the arm of the support element 24 opposite the connecting region used for the tensile load is therefore supported on the outer side of the associated web element 11. The side walls of the web elements 21 can here, similar to the end regions 15, have an inwardly directed chamfer towards the bottom region in order to prevent accidental loosening in the event of a tensile load.

The alternative exemplary embodiment of the connecting element shown in FIGS. 10 and 11 has the same configuration and mode of operation as the exemplary embodiment described in FIGS. 1 to 7, except for the differences explained in more detail below, so that reference is first made to the description there.

Figure 10:
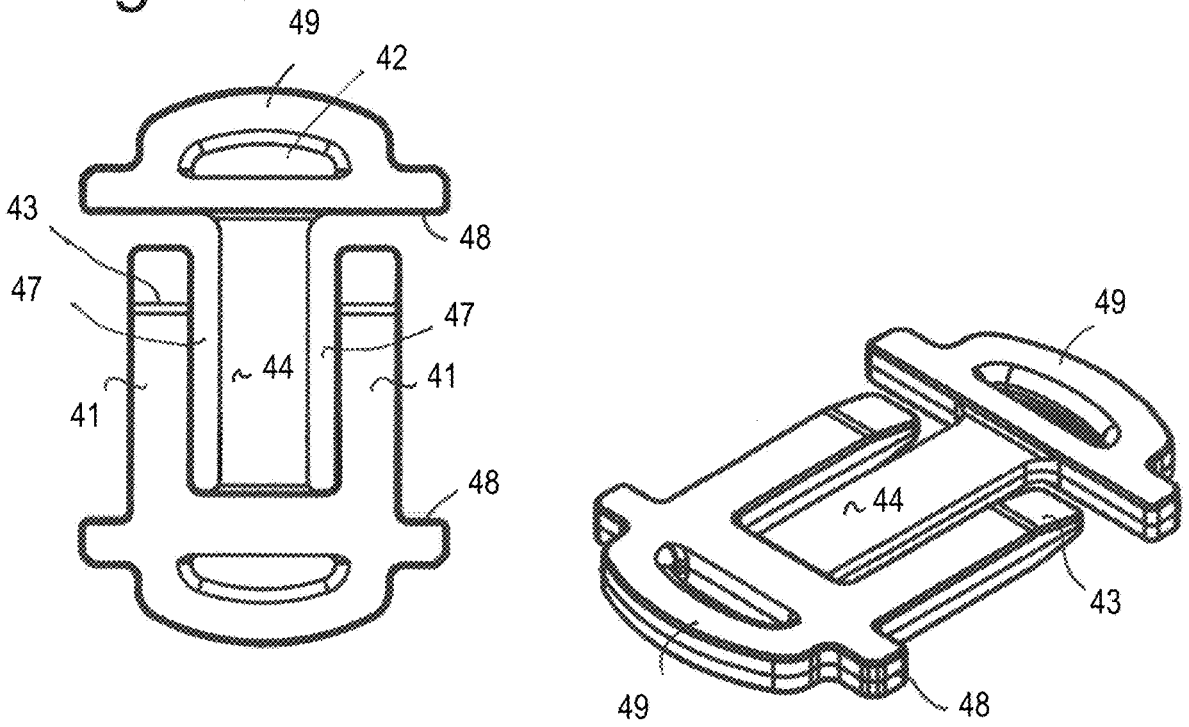
Figure 11:
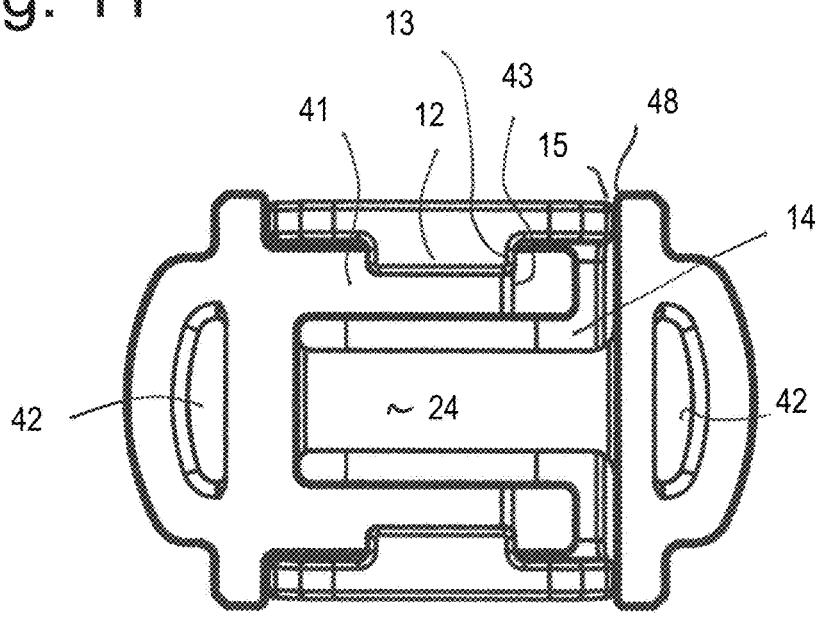
FIG. 11 another view of the third alternative exemplary embodiment.

However, in the alternative embodiment of the connecting element shown in FIGS. 10 and 11, which cooperates with the same base element as the other embodiments, the support element 44 extends differently from the other embodiments in the region between the web elements 11. Furthermore, two spring arms 41 are provided, which extend on both sides of the centrally extending support element 44, with both the spring arms and the support element 44 extending between the web elements 11. The area of the support element 44 in which it extends parallel to the spring arms 41 is separated from the spring arms by slot-shaped recesses 47.

This embodiment also allows spring arms 41 and support element 44 to be bent in opposite directions in order to slide the spring arms under the retaining elements 12 of the web elements 11. Here, too, the region of the support element 44 in which it extends parallel to the spring arms 41 is made thinner than the end regions of the support element and the spring arms 41.

The edges 48 of the support element, with which the latter engages around the web elements 11 in their end regions 15, are formed by projections of the support element which project in the two end regions of the support element. The function of these edges 48 corresponds to that of the edges 28 of the first exemplary embodiment. In particular, these slide on the upper side of the web elements 11 when the buckle is being closed, and engage around the end regions 15 in the closed position.

Connecting elements 42 are provided in the end regions, which are formed by recesses. The closed recesses 42 create a web 49 around which a webbing loop can be placed.

In the exemplary embodiment shown in FIGS. 10 and 11, connecting regions 42 are provided on both longitudinal sides of the connecting element.

The present disclosure provides an easy-to-use, stable connection of the connecting element to the base element, through the interaction of which functional elements can be attached to a webbing loop.

Figure 4A:
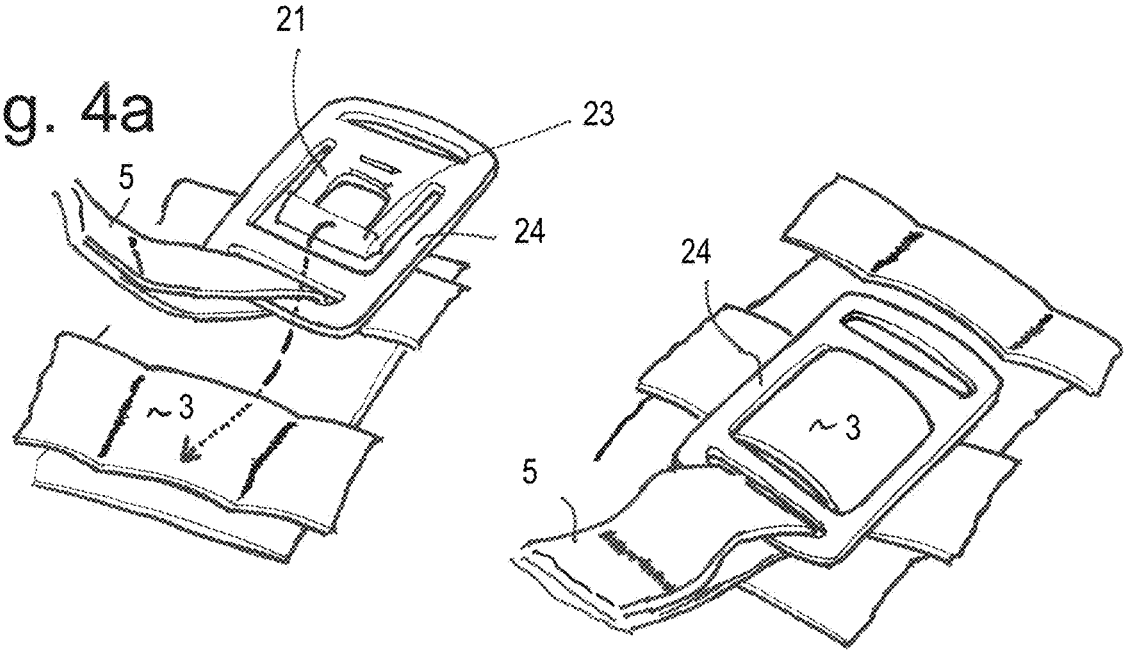
Figure 5:
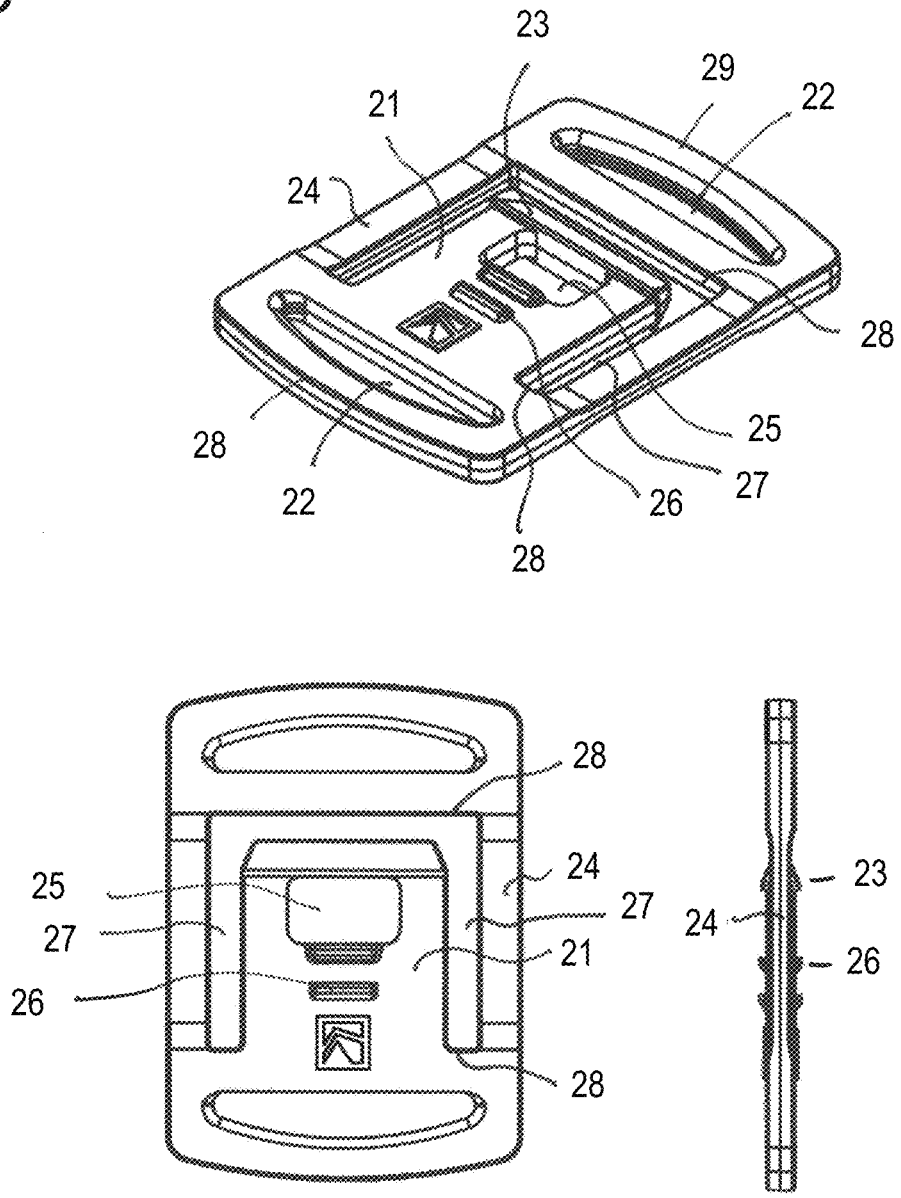

Furthermore, the connecting element can also be attached directly to the webbing loop 3 as shown in FIG. 4*a*, by pushing the spring arm 21 behind the webbing loop 3 and then passing through the recesses 27 between the spring arm 21 and the support element 24. Such a connection would also be possible in the exemplary embodiment in FIGS. 10 and 11 by pushing the two spring arms behind the webbing loop, which then extends through the recesses 47. In this way, a connection in the transverse direction of the loop is possible.

Figure 4B:
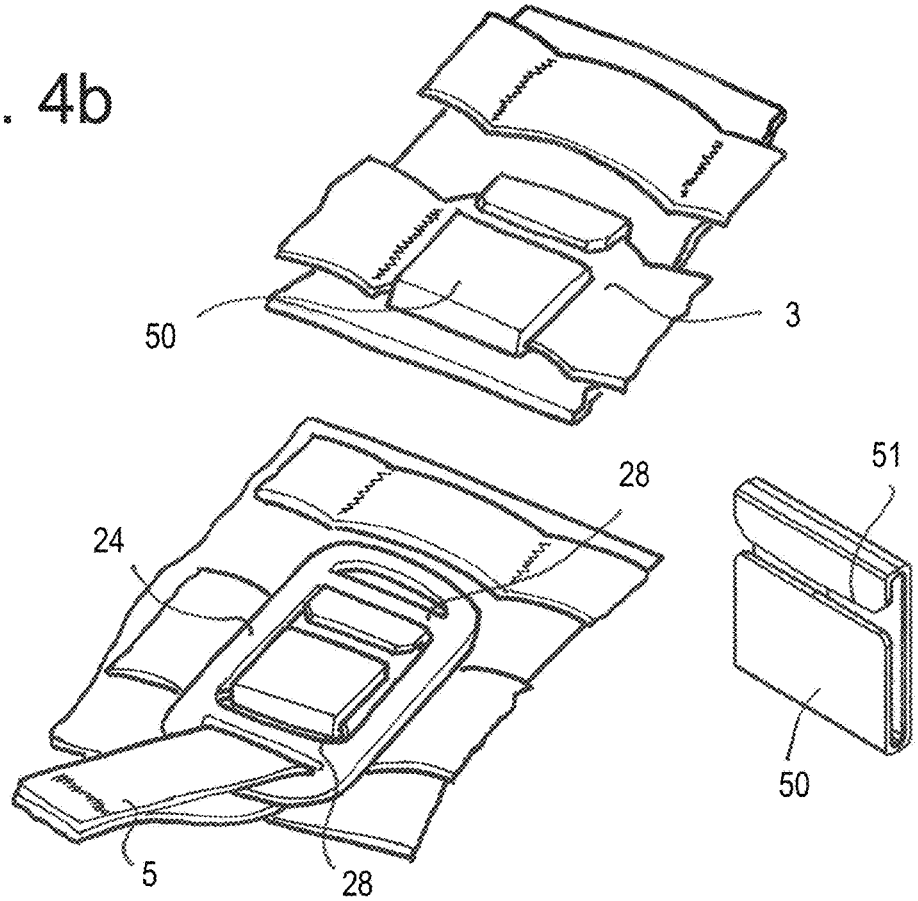

As shown in FIG. 4*b*, a reinforcement element 50 can be used in this type of connection to reinforce the webbing loop 3 so that it cannot deflect when the buckle is loaded.

The reinforcement element 50 surrounds the webbing loop 3 in a sleeve-shaped manner in the assembled state. It has dimensions which allow the support element 24 to surround the reinforcement element 50 in a frame-like manner in the assembled state. The region of the webbing loop 3 under which the spring arm 21 has been slid is stabilized by the reinforcement element 50. Furthermore, the reinforcement element rests on the spring arm 21 in the assembled state, so that when the connecting element is loaded in or against the assembly direction, the edges 28 interlock with the reinforcement element 50.

The reinforcement element 50 comprises a slot 51 extending in the longitudinal direction, by means of which it can be pushed onto the webbing loop.

If the reinforcement element 50 is mounted in such a way that the slot 51 is arranged to face away from the visible surface on the rear side of the webbing loop, the edges of the slot 51 together with the latch element 23 of the spring arm 21 lead to a continuation of the securing function by interlocking during disassembly.

The webbing loop 3 may in particular be a PALS loop of a MOLLE attachment system.

The webbing loop 3 can be provided, for example, by sewing a webbing strap 2 onto a carrier layer 1. In particular, a webbing strap can be connected to the carrier layer 1 at regular intervals via darts 4 to provide several webbing loops along the webbing strap 2.

In a MOLLE system, several rows of loops are usually arranged next to or above each other in such a way that webbing straps can be threaded through them to connect functional elements to the rows of loops.

However, the webbing loops can also be provided by slots in a layer of material through which webbing straps can be threaded in the same manner as in an embodiment having the sewn-on webbing straps described above.

However, the buckle can also be used to connect with any other loops.

The invention claimed is:

1. A buckle for connecting a functional element to a webbing loop, having a base element which comprises a bottom region and two web elements and which can be inserted under the webbing loop in such a way that the bottom region is arranged below the webbing loop and the web elements engage around the webbing loop on both sides, and a connecting element which can be latched to the web elements of the base element with the connecting element arranged on top of the webbing loop, wherein the bottom region connects the web elements in a direction transversal to the extension of the webbing loop, the bottom region and the web elements form a channel open to the top for receiving the webbing loop, the connecting element comprises a support element which engages around the web elements of the base element in the connected state, and the connecting element comprises at least one spring arm, at a free end of which a latch element is provided.

2. The buckle according to claim 1, wherein the at least one spring arm for connection to the base element is insertable under at least one retaining region of the web elements, and wherein the at least one retaining region projects inwardly from the web elements and the latch element latches with the retaining region from below.

3. The buckle according to claim 2, wherein the at least one spring arm for connection to the base element is insertable under at least one retaining region of the web elements and rests on the webbing loop, and wherein a counter element of the latch element is formed by an end region of the retaining region.

4. The buckle according to claim 1, wherein an engagement of the latch element with the base element is releasable by pressing the spring arm towards the bottom region.

5. The buckle according to claim 1, wherein the at least one spring arm extends between the web elements in the connected state.

6. The buckle according to claim 1, wherein end portions of the web elements engaged around by the support element are chamfered inwardly toward the bottom region.

7. The buckle according to claim 6, wherein the support element, when pulled away from the base element in a direction parallel to an extension of the webbing loop, braces with the end portions.

8. The buckle according to claim 1, wherein the support element surrounds the web elements in the connected state in a frame-like manner on the outer sides thereof.

9. The buckle according to claim 1, wherein the connecting element is plate-shaped and extends parallel to the bottom region of the base element in the connected state.

10. An article, comprising a buckle according to claim 1.

11. The article of claim 10, wherein the article is a ballistic protective vest, and wherein the buckle is suitable for connecting a ballistic element to the ballistic protective vest, including for connecting a ballistic plate to a shoulder webbing loop of the ballistic protective vest.

12. The buckle according to claim 1, wherein the latch element can be latched to at least one counter element arranged on a web element of the base element.

13. A buckle for connecting a functional element to a webbing loop, having a base element which comprises a bottom region and two web elements and which can be inserted under the webbing loop in such a way that the bottom region is arranged below the webbing loop and the web elements engage around the webbing loop on both sides, and a connecting element which can be latched to the web elements of the base element with the connecting element arranged on top of the webbing loop, wherein the bottom region connects the web elements in a direction transversal to the extension of the webbing loop, the bottom region and the web elements form a channel open to the top for receiving the webbing loop, and the connecting element comprises a support element which engages around the web elements of the base element in the connected state, and wherein the connecting element comprises at least one spring arm comprising at least one latch element for latching with a first counter element arranged on a first web element out of the web elements and the support element is provided in addition to the spring arm and engages, in addition to a latching connection provided by the at least one latch element and the first counter element, around a first and a second end of the web element in the connected state.

14. The buckle according to claim 13, wherein the support element in the connected state extends between the web elements, wherein two spring arms are provided, which extend on both sides of the support element between the support element and the web elements, wherein the support element engages around the end regions of the web elements and for this purpose comprises widened regions which engage around the end regions of the web elements with their inner edges.

15. The buckle according to claim 13, wherein the support element and at least one spring arm of the connecting element extend parallel to each other in a deformation region of the support element and are separated from each other by a slot-shaped recess, so that the support element and the spring arm are deformable in opposite directions perpendicular to a plane of the webbing element.

16. The buckle according to claim 13, wherein the connecting element comprises at least one connecting region for connection to a webbing element, in the form of a recess through which the webbing element can be guided, in the form of an elongated hole.

17. The buckle according to claim 16, wherein the at least one connecting region is provided in an edge region of the connecting element, wherein the connecting region is arranged outside a base area of the base element in the connected state, and/or wherein the connecting element comprises a connecting region in at least two opposite edge regions.

18. A connecting element for a buckle according to claim 13, wherein the connecting element comprises at least one spring arm and at least one support element, wherein the at least one spring arm comprises at least one latch element for latching with a first counter element arranged on a first web element out of the web elements and the support element, provided in addition to the spring arm, is configured to engage, in addition to a latching connection provided by the at least one latch element and the first counter element, around a first and a second end of the first web element in the connected state, and wherein the support element and the at least one spring arm extend parallel to each other in a deformation region of the support element and are separated from each other by a slot-shaped recess.

19. The buckle of claim 13, wherein the at least one latch element is further configured to latch with a second counter element arranged on a second web element out of the web elements, and wherein the support element is further configured to engage, in addition to a latching connection provided by the at least one latch element and the second counter element, around a first and a second end of the second web element in the connected state.

20. A buckle for connecting a functional element to a webbing loop, having a base element which comprises a bottom region and two web elements and which can be inserted under the webbing loop in such a way that the bottom region is arranged below the webbing loop and the web elements engage around the webbing loop on both sides, and having a connecting element which can be latched to the web elements of the base element arranged on the webbing loop, wherein the connecting element comprises a support element which engages around the web elements of the base element in the connected state, wherein the support element surrounds the web elements in the connected state in a frame-like manner on the outer sides thereof, wherein the connecting element comprises at least one spring arm, at a free end of which a latch element is provided, wherein the spring arm extends between the web elements, wherein the web elements pass through two recesses arranged between the spring arm and the support element, and wherein the end portions of the recesses engage around the end portions of the web elements.

* * * * *